US009951619B2

(12) United States Patent
Stanovskoi et al.

(10) Patent No.: US 9,951,619 B2
(45) Date of Patent: Apr. 24, 2018

(54) ACTUATOR OF A ROTARY POSITIVE DISPLACEMENT MACHINE

(71) Applicant: Viktor V. Stanovskoi, Tomsk (RU)

(72) Inventors: Viktor V. Stanovskoi, Tomsk (RU); Sergei M. Kazakiavichius, Tomsk (RU); Vladimir M. Kuznetsov, Tomsk (RU); Aleksandr V. Skovorodin, Tomsk (RU); Tatiana A. Remneva, Tomsk (RU); Nikolai V. Zakharkin, Seversk (RU)

(73) Assignee: ZAO "Technology Market", Tomsk (RU)

( * ) Notice: Subject to any disclaimer, the term of this patent is extended or adjusted under 35 U.S.C. 154(b) by 48 days.

(21) Appl. No.: 15/066,351

(22) Filed: Mar. 10, 2016

(65) Prior Publication Data

US 2017/0009583 A1 Jan. 12, 2017

Related U.S. Application Data

(63) Continuation of application No. PCT/RU2014/000660, filed on Sep. 4, 2014.

(30) Foreign Application Priority Data

Sep. 10, 2013 (RU) ..... 2013141721

(51) Int. Cl.
*F01C 1/24* (2006.01)
*F03C 2/00* (2006.01)
(Continued)

(52) U.S. Cl.
CPC ..... *F01C 21/08* (2013.01); *F01C 1/084* (2013.01); *F01C 1/16* (2013.01); *F01C 1/20* (2013.01);
(Continued)

(58) Field of Classification Search
CPC ..... F04C 2/16; F04C 18/16; F04C 23/008; F04C 2240/20; F04C 2240/30;
(Continued)

(56) References Cited

U.S. PATENT DOCUMENTS 2,622,787 A * 12/1952 Nilsson ..... F04C 18/16 418/201.3
3,182,900 A * 5/1965 Thorson ..... F04C 18/084 418/206.5
(Continued)

FOREIGN PATENT DOCUMENTS

EA 015293 B1 6/2011
RU 2062907 C1 6/1996
(Continued)

OTHER PUBLICATIONS

International Search Report, from PCT/RU2014/000660, filed Sep. 4, 2014, dated Nov. 20, 2014.
(Continued)

*Primary Examiner* — Theresa Trieu
(74) *Attorney, Agent, or Firm* — Patentbar International, P.C.

(57) ABSTRACT

Disclosed are rotary positive displacement machines capable of acting as an engine and as a pump, serving to improve the profile of working members of helical rotary engines, compressors and pumps. An actuator is comprised of a pair of rotors having engaged helical teeth. The rotors are disposed in chambers which encircle both. The working areas of the profiles of the teeth in an engaged pair are delineated in cross-section by portions of a cycloidal curve for one rotor and by arcs of circumferences which are eccentrically offset from the axis of the second rotor. Such a profile of teeth produces an eccentrically cycloidal engagement capable to work efficiently at very high rotor rotation speeds. The presence of power contact and low sensitivity to
(Continued)

gearwheel skews allow for working with nonhomogeneous media, including those containing solid inclusions.

7 Claims, 7 Drawing Sheets

(51) Int. Cl.

| | |
|---|---|
| ***F03C 4/00*** | (2006.01) |
| ***F04C 2/00*** | (2006.01) |
| ***F01C 21/08*** | (2006.01) |
| ***F01C 1/16*** | (2006.01) |
| ***F01C 21/10*** | (2006.01) |
| ***F01C 1/08*** | (2006.01) |
| ***F01C 1/20*** | (2006.01) |
| *F04C 2/16* | (2006.01) |

(52) U.S. Cl.
CPC ..... *F01C 21/104* (2013.01); *F04C 2/16* (2013.01); *F04C 2240/20* (2013.01); *F04C 2240/30* (2013.01); *F04C 2250/20* (2013.01)

(58) Field of Classification Search
CPC ..... F04C 2250/20; F01C 1/16; F01C 1/084; F01C 1/20; F01C 21/08; F01C 21/104
USPC ..... 418/201.1, 201.3, 206.5
See application file for complete search history.

(56) References Cited

U.S. PATENT DOCUMENTS 6,837,123 B2 * 1/2005 Hawkins ..... F16H 55/08 74/457
2012/0291578 A1 * 11/2012 Stanovskoy ..... F16H 55/08 74/462

FOREIGN PATENT DOCUMENTS

| | | | |
|---|---|---|---|
| RU | 2215189 | C2 | 10/2003 |
| RU | 2250340 | C2 | 4/2005 |
| RU | 92489 | U1 | 3/2010 |
| RU | 97471 | U1 | 9/2010 |
| RU | 2416748 | C1 | 4/2011 |
| SU | 125860 | | 1/1960 |
| SU | 292044 | | 1/1971 |
| SU | 1032255 | A | 7/1983 |
| SU | 1751408 | A1 | 7/1992 |

OTHER PUBLICATIONS

Kazakyavichyus S.M. et al, Performance of Eccentric—Cycloid Engagement with Change in the Interaxial Distance: Modification of Tooth Configuration, Russian Engineering Research, 2011, pp. 197-199, v. 31, No. 3.
Zhmuda A. E., Screw pumps with cycloidal engagement, M.: Mashis, 1963, pp. 5-9, 26-27.
Stanovskoy et al, Double-stage gearbox based on the eccentrically cycloidal engagement (Engagement ExCyGear), Vestnik mashinostroeniya—2011, pp. 41-43, No. 12.

* cited by examiner

ACTUATOR OF A ROTARY POSITIVE DISPLACEMENT MACHINE

RELATED APPLICATIONS

This Application is a Continuation application of International Application PCT/RU2014/000660, filed on Sep. 4, 2014, which in turn claims priority to Russian Patent Applications No. RU 2013141721, filed Sep. 10, 2013, both of which are incorporated herein by reference in their entirety.

FIELD OF THE INVENTION

The invention relates to the field of rotary positive displacement machines capable of acting as an engine and as a pump and relates to improving the profile of the working members of helical rotary engines, compressors and pumps. The helical rotary machine can be used as a pump for conveying viscous and multi-phase liquids, for example, as a well pump for oil extraction or slush pump for well boring, and as hydraulic and pneumatic drives in control and regulatory systems, for expanders, separators, steering machines, lifting devices and so on.

BACKGROUND OF THE INVENTION

In the most general case an actuator of a helical rotary pump represents pair-wise interacting helical rotors disposed into an encircling chamber. The tooth profile of rotor helical thread can have different shapes: an ellipse and an envelope in the inventor's certificate SU125860, an involute and a special conjugate curve in the inventor's certificate SU 1032255, a set of involutes producing a quasi-cycloidal profile in the inventor's certificate SU 292044. The tooth contact of rotors is accompanied by great slippage in actuators with the said tooth profiles, causing great friction losses and reducing their durability. A helical pump is known with an actuator representing a cage with chambers where two helical rotors are mounted (SU 1751408). Each rotor has one helical tooth of a cycloidal shape. Working areas of the tooth addendum at cross-section are produced (here) along an epicycloid and conjugated areas of the tooth dedendum are drawn by a hypocycloid. Helical teeth of rotors are conjugated with each other and one of rotors is driving and the other is driven. Rotation from the driving rotor to the driven one is transmitted by synchronizing pinions mounted on rotor shafts, thus increasing overall dimensions of the pump and complicating its layout.

The patent RU 2062907 describes a pump with an actuator also having two single-thread rotors with synchronizing pinions. In order to create smoother force profile, segments of epy- and hypocycloids are conjugated by means of an involute.

A two-screw pump is known for conveying high-viscosity media according to the patent RU 92489. Helical rotors in its pressure chamber are made double-thread, that is, with two cycloidal teeth. Such a shape of teeth gives the tight contact between rotors at any angle of rotation, thus providing leak resistance. As in the previous pump, torque transmission from one rotor to another is provided by means of synchronizing pinions. Because of the tight contact considerable friction forces appear between rotors, decreasing the pump efficiency and increasing its wear and reducing its lifetime.

Screw pumps with cycloidal rotors are known (see Zhmud A. E. Screw pumps with cycloidal engagement.—M.: Mashiz, 1963). Theory and technology of manufacturing stated in the book are applicable to screw pumps designing with any number of rotors. Cycloidal pumps with three double-thread rotors are the most common A driving helical rotor has two teeth with convex cycloidal profile at its cross-section. Two driven rotors arranged at both sides from the driving one have two concave cycloidal teeth with sharp edges. Geometrical relations of helical threads are chosen to provide leak resistance of actuators when the torque is not transmitted, that is, there is a slotted clearance between teeth. When rotors rotate the slotted clearance will be displaced along the tooth height and rotor flanks will possess different speed within the slot area, since rotors with cycloidal teeth are always slipping with respect to each other. This difference in flow speeds at rotor flanks causes cavitation limiting the rotor rotational speed. Synchronization of rotors is provided only due to medium pressure and this medium is inhomogeneous (for example, gas inclusions in liquid medium), this synchronization will be broken thus leading to the leakage, the power contact of rotors and the wear increase. Such contact is especially harmful for driven rotors with sharp edges. In order to prevent rapid wear, sharp edges of driven rotors are abated by one or two chamfers (see also RU 2215189). Moreover, the slotted clearance can provide leak resistance only for liquids with definite flow characteristics. When pumping high-flow liquids the pump will have great reverse leakages decreasing its productivity abruptly. This pump is unsuitable for operation in media with little solid inclusions, since because of slippage they are entrapped by the slot and when displacing across the tooth they create transverse valleys on rotor flanks. That is why such a pump can be applied for pumping rather viscous, thick and homogeneous media without solid inclusions.

Therefore, independently on a shape of helical teeth, rotors for all the said pumps are produced to exclude the power contact between rotors and rotation of driven rotors is provided either by additional synchronizing pinions or due to the pumped liquid pressure. This is explained by the fact that the power contact of rotors, firstly, limits the lifetime of an actuator because of increased friction forces in engagement, secondly, limits the rotor rotation speed due to torque pulsation. With increase of the rotor rotation speed, overall dimensions and weight of a machine are decreased at other equal conditions.

The said book (see p. 26) states that the design of a helical pump with cycloidal engagement possesses reversibility, that is, it can operate as an engine, including a hydraulic rotating servomotor. Therefore, we can speak about this mechanism as a helical rotary machine with one and the same actuator as helical rotors engaging pair-wise and being disposed into an encircling chamber. The tooth profile of one of the rotors in the pair is generated in its cross-section by convex segments of an epicycloid and the tooth profile of the other rotor in the said pair is generated by concave segments of an epicycloid with the slotted contact between them. The slotted contact provides mutual leak resistance of screws seal for homogeneous liquids with definite flow characteristics. The said actuator with cycloidal rotors and the slotted contact between rotors is chosen as a prototype. The drawback of the prototype, as it was stated above, is limitation of rotor rotation speed and limitation of working media characteristics.

Therefore, the task of creating a helical rotary machine with high productivity at long lifetime and high efficiency is still urgent.

SUMMARY OF THE INVENTION

The technical result of the proposed invention is the increase of allowable rotational velocity of rotors and widening the range of working media characteristics.

The additional technical result is the reduction of the actuator sensitivity to variation of the distance between rotors, that is, to manufacturing errors.

The said technical results are achieved due to the definite tooth shape of conjugating rotors. For this purpose, the actuator of a helical machine (like the prototype) has helical rotors engaged pair-wise with each other. Rotors are disposed into an encircling chamber. One of rotors in pair has helical teeth with their profile in the cross-section generated by convex segments of front edges of a cycloidal curve. Unlike the prototype the second rotor in pair has helical teeth with their profile in the cross-section generated by arcs of circumferences eccentrically offset from the rotor axis. As the result, helical teeth in pair produce an eccentrically cycloidal (EC) engagement. This engagement and its characteristics are described in patent RU 2416748 and also in the paper by Stanovskoy V. V., Kazakyavichyus S. M., Remneva T. A. et al. Double-stage gearbox based on the eccentrically cycloidal engagement (Engagement ExCy-Gear)//Vestnik mashinostroeniya—2011.—N12, pp. 41-43.

There can be any number of teeth in rotors. However, as it is shown below, the best technical and economical characteristics are provided for the tooth number within the range 3-5.

BRIEF DESCRIPTION OF THE DRAWINGS

The invention is illustrated by graphic information.

FIG. 1 shows the general view of the said actuator,

FIG. 2 gives the cross-section of rotors,

FIG. 3 presents the general view of the displaced volumes,

FIG. 6 is the front view of rotors for the said actuator, FIG. 7 is the cross-section and FIG. 8 is the general view of the displaced volumes.

DETAILED DESCRIPTION OF THE PREFERRED EMBODIMENTS

Figure 1:
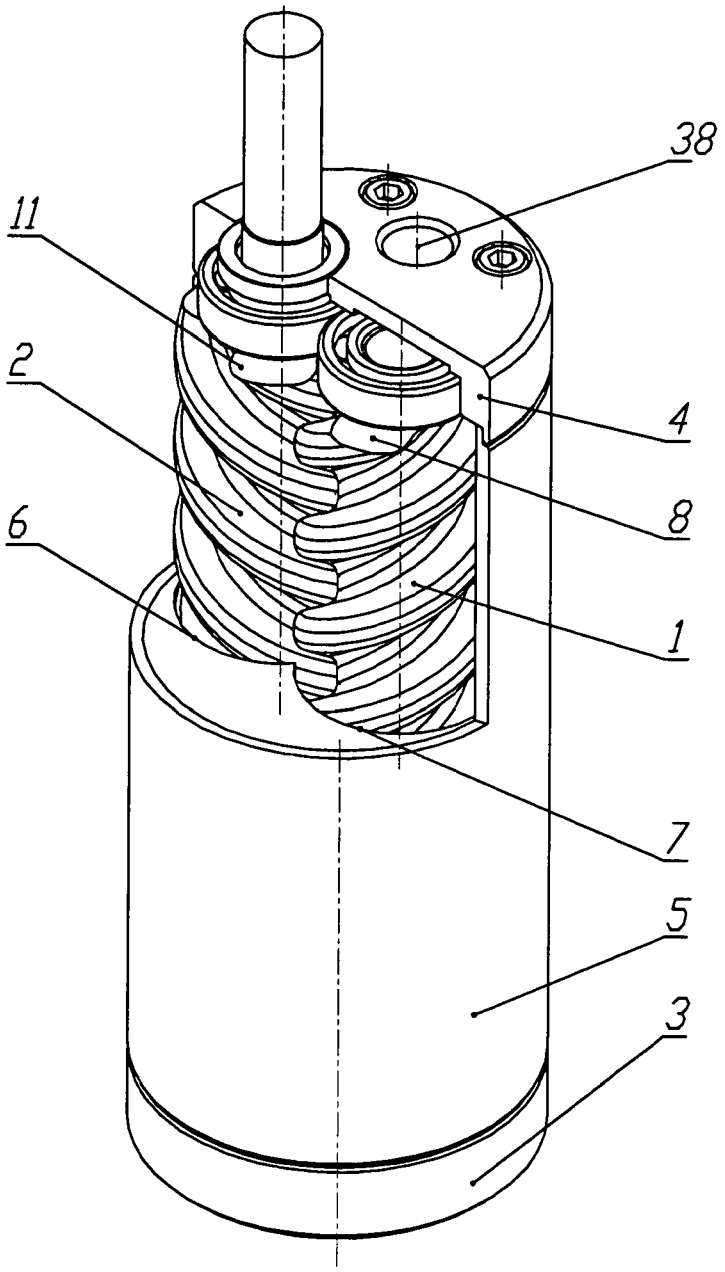
FIGS. 1, 2, 3 illustrate an actuator comprising two rotors with equal diameter having three helical teeth each.
Figure 2:
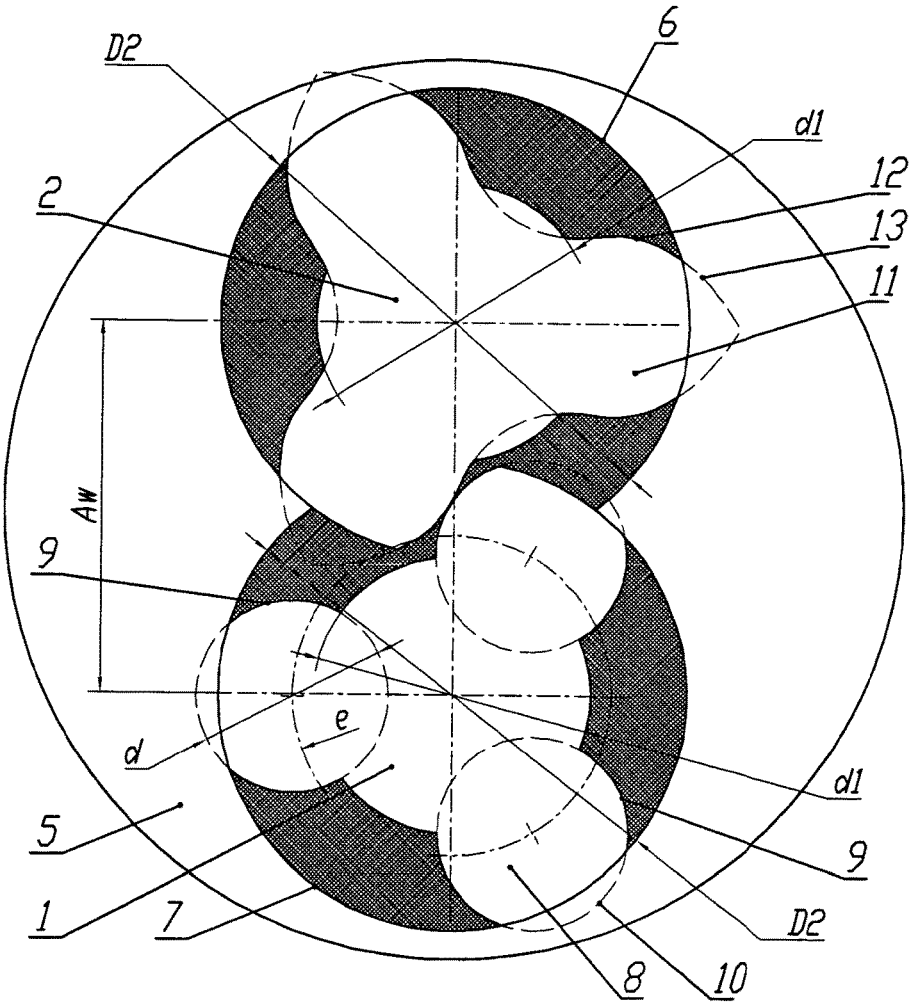
Figure 3:
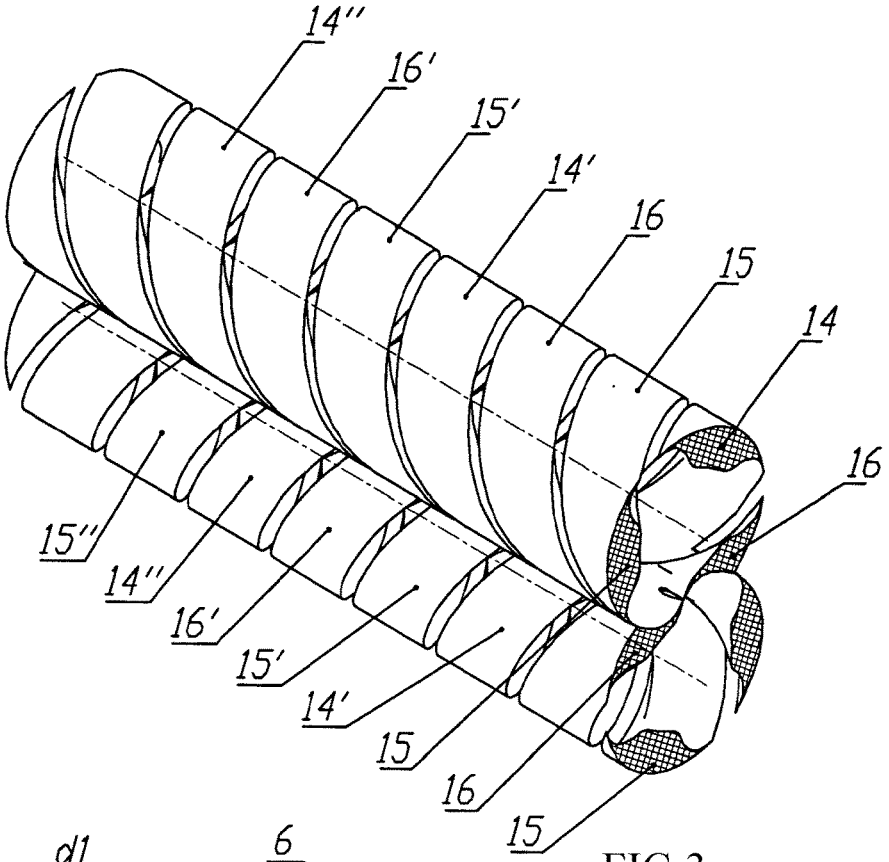

Let us consider the actuator of the rotor machine illustrated in FIGS. 1, 2 and 3. The actuator comprises two parallel rotors 1 and 2 mounted with possibility of rotation within face caps 3 and 4 of the casing 5. Similarly, to any known helical machine, rotors are arranged in tight encircling chambers 6 and 7 of the casing. The rotor 1 has three helical teeth 8. The working profile of helical teeth 8 in the cross-section is generated by arcs 9 of circumferences 10, eccentrically offset from the rotor axis by the distance e (see FIG. 2). Circumferences 10 have the diameter d. Apexes of teeth 8 are cut off by the cylindrical surface of the diameter D2. The space between teeth 8 is generated by a cylindrical surface of the diameter d1. The letter $A_w$ designates the interaxial distance between rotors. Profile of working flanks of helical teeth 11 of the rotor 2 in the cross-section is generated by convex segments 12 of the cycloidal curve 13 (a dashed line in FIG. 2). The cycloidal curve 13 represents the equidistant line of the epicycloid offset from it by the distance d. The epicycloid is generated when the generating circumference of the radius e is rolled without slipping along the guiding circumference from the outside. Apexes of cycloidal teeth 11 are generated by a cylindrical surface. Since in this actuator rotors have the same dimensions, the diameter of the cylindrical surface of the gearwheel 11 is also equal to D2 and the space between teeth is generated by a cylindrical surface d1. Helical teeth 8 and 11 form the toothed eccentrically cycloidal (EC) engagement, that is, rotation of the rotor 2 will be provided due to the power contact of teeth in the EC engagement. The power contact of rotors means that leak resistance of volumes is achieved not because of the slotted sealing as in the prototype, but due to the direct tight contact of surfaces. Characteristics of the pumped liquid (its inhomogeneity and flow behavior) will not influence here the level of leak resistance essentially. Technically, the power contact of rotors can be provided by the toothed engagement of any profile. However, such actuators can operate only at high accuracy of manufacturing and in the presence of lubrication.

The EC engagement has a number of characteristics that allow its effective application in a helical machine. Thus, it is shown in the paper by Kazakyavichyus S. M., Stanovskoy V. V., Remneva T. A. et al. Operation ability of the eccentrically cycloidal engagement at variation of interaxial distance of gearwheels. Modification of tooth addendums and dedendums//Vestnik mashinostroeniya—2011.—N3, pp. 7-9, that the EC engagement is low sensitive to interaxial distance variation of gearwheels. When the clearance between gearwheels appears, the additional turn of one of the gearwheels takes place and the power contact in the engagement is recovered. The engagement operates similarly in the presence of solid inclusions in the pumped media. When a solid particle (for instance, a grain of sand) appears between rotor flanks, the delay of the driven rotor occurs with forming the clearance, and its additional turn and recovery of the leak-proof contact of rotors take place. Since rotors are rolled with respect to each other without slippage, the grain of sand comes through the area of rotor contact not being entrapped there.

Further, as our investigations of the EC engagement showed, in a real engagement under load the contact pattern will be displaced on the helical line along the helical tooth, constantly being at the same distance from the center of rotor rotation. It means, that the transmitted torque will not have pulsations and such engagement will be serviceable even at very high number of revolutions, up to 200000 rev per minute. The mode of pure rolling provided by the EC engagement decreases the difference in velocities between two screws along the contact line to practically zero value. This in turn shifts the boundary of cavitation appearance to the range of high velocities.

Moreover, the situation can be achieved in the EC engagement by selecting the engagement parameters (tooth number n, diameter of the generating circumference d and its eccentricity e, interaxial distance between screws $A_w$), when the tooth contact point B will always be at the pitch point. It means that the mode of pure rolling is implemented and sliding of rotors with respect to each other is practically absent. Rolling friction is one-two orders less than the sliding friction between one and the same surfaces. Therefore, rotors with the EC engagement can work in the absence of lubrication, that is, in liquid media with gas inclusions.

Investigations on implementing the "pitch point" engagement showed that it can be achieved for the engaged pair with any tooth number n, by selecting the eccentricity e and diameter of the generating circumference d for the pre-assigned interaxial distance $A_w$. However, in some cases, the tooth thickness of a screw can be considerably less than the tooth thickness of another screw and smaller value will determine the strength of the actuator as a whole. It was defined that the optimal tooth number to implement the "pitch point" engagement at equal tooth strength of both gearwheels in the engaged pair is 3-5.

Figure 4:
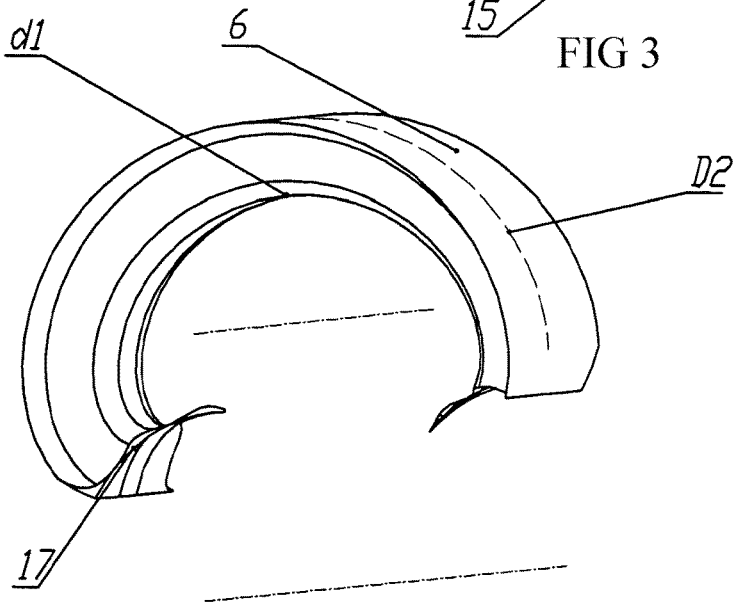
FIG. 4 shows the unit leak proof segment of the helical volume for the actuator of FIG. 1.

Therefore, interacting with the inner surface of the chamber in the casing, each rotor generates three (according to the number of helical teeth) open helical volumes 14, 15 and 16 shown in FIG. 3. The said volumes are separated by the surface of tooth contact of rotors with each other into individual leak proof canals—threads designated by digits 14', 15', 16', 14", 15",16", etc. One of these leak proof threads is shown in FIG. 4. The outer surface of the thread is generated by the cylindrical surface of the chamber 6 and it has the diameter D2. The inner surface of the thread is generated by the cylindrical surface d1. Lateral surfaces of the thread are limited by the helical surface generated by segments of the cycloidal curve 12. End faces are sealed by the surface of contact 17 of helical teeth 8 and 11.

Figure 5:
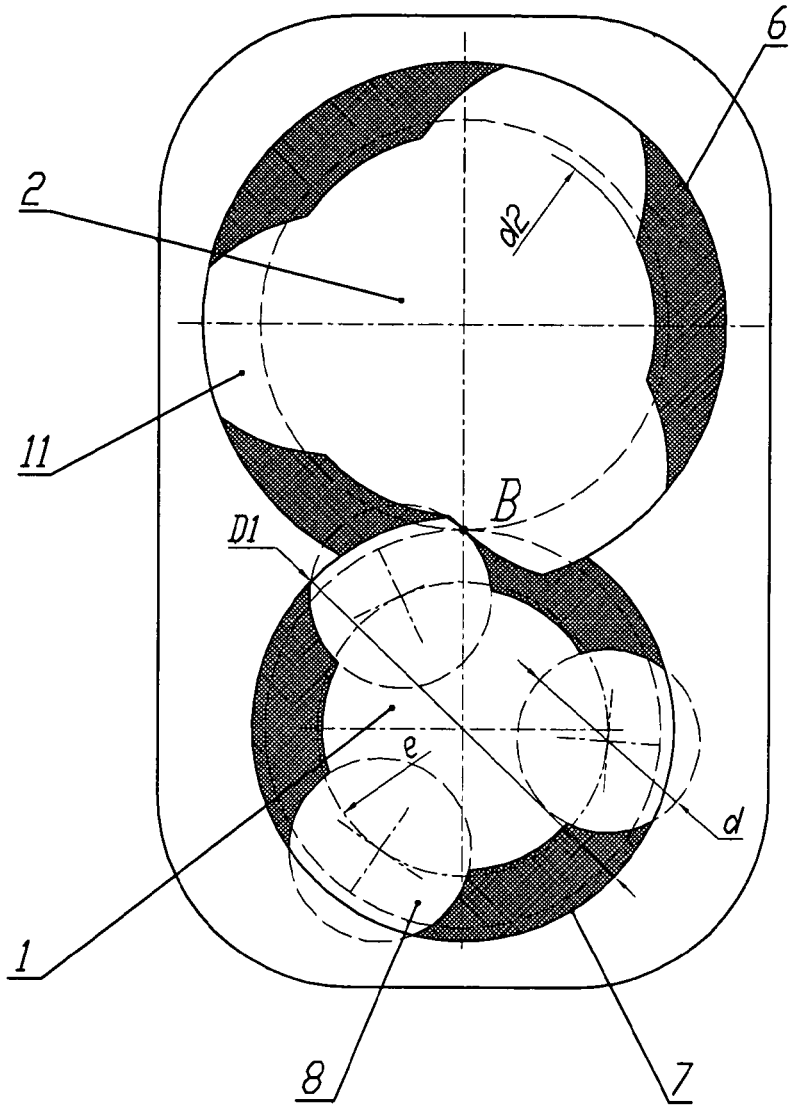
FIG. 5 presents the cross-section of rotors with different diameters.

The actuator comprising the pair of rotors of the same diameter was considered above. One of rotors is either powered from the engine (when the machine is operating as the pump), or it transmits the torque to the actuator (when the machine is operating as a hydro- or pneumatic drive). Let us call this rotor the power or the driving one. Another rotor in the pair performs the function of a sealer; let us call it the sealing or the driven one. In the pair of rotors, the sealing rotor is always under lower power loads. That is why in order to decrease the overall dimensions of the actuator the sealing rotor may have smaller diameter. The cross-section of such actuator is shown in FIG. 5. Here the rotor 1 is the sealing one and it has smaller diameter than the rotor 2. The diameter D1 of the cylindrical surface limiting the tooth apexes 8 of the rotor 1 is related here to the diameter d2 of the cylindrical surface of tooth roots 11 of the rotor 2 by the following dependence: $(D1+d2)/2=A_w$. Diameters of tooth apexes 11 and tooth roots 8 are related similarly.

Figure 6:
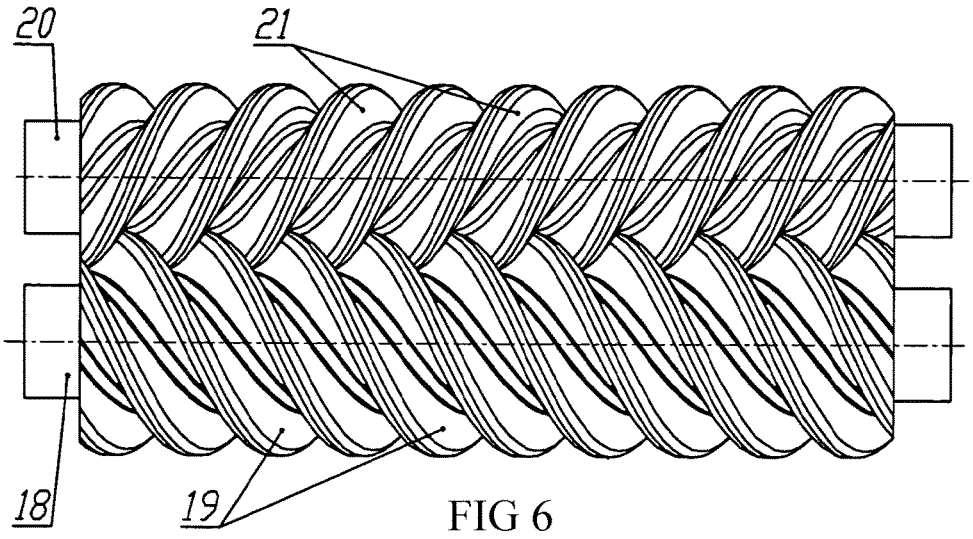
FIGS. 6, 7, and 8 illustrate an actuator comprising also two helical rotors with different diameters and having different tooth numbers (3 and 4 correspondingly).
Figure 7:
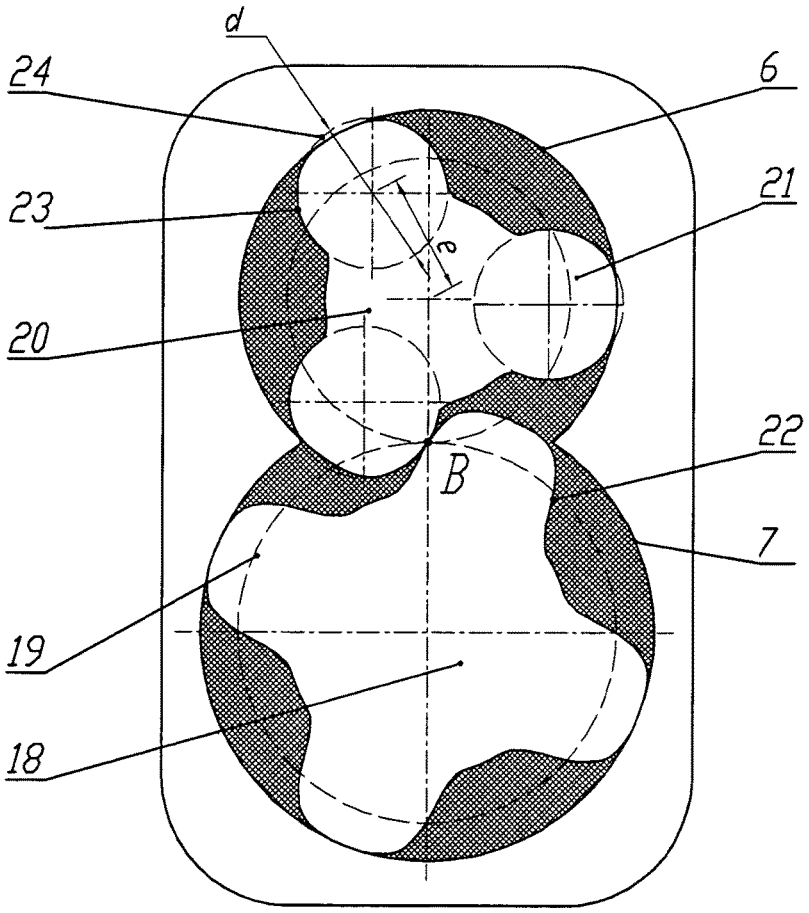
Figure 8:
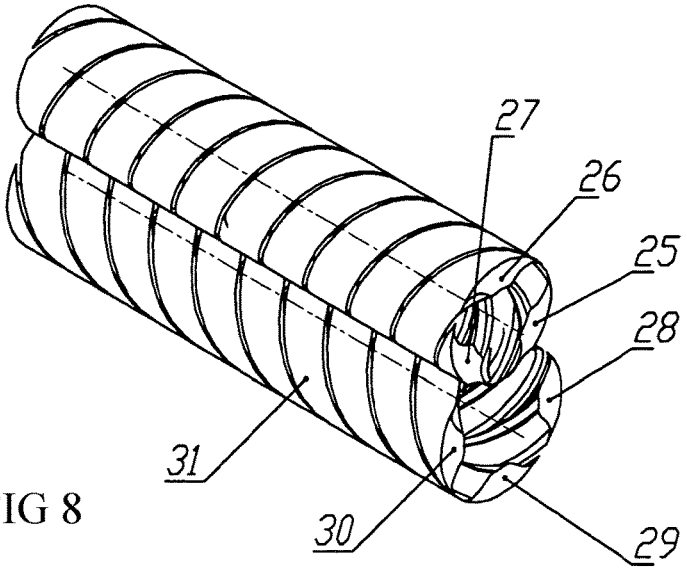

Let us consider the actuator in FIGS. 6, 7 and 8. Here the power rotor 18 of the greater diameter has 4 helical teeth 19 and the rotor 20 of the smaller diameter is the sealing one and it has three helical teeth 21. Working areas of teeth of the power rotor 18 are outlined in the cross-section by convex segments 22 of the cycloidal curve and working areas of teeth of the rotor 20 are outlined by arcs 23 of circumferences 24 of the diameter d. Circumferences 24 are eccentrically offset from the axis of the rotor 20 rotation by the distance e. Teeth with such a profile generate the EC engagement with the point of tooth contact B located at the pitch point. It means that rotors rotate without slippage at the point of contact. When interacting with walls of the chamber 6 of the casing, the rotor 20 produces three helical transmitted volumes 25, 26, 27, and the rotor 18 produces four helical volumes 28, 29, 30, 31, correspondingly (see FIG. 8). These volumes are separated into individual leak proof areas by surfaces of contact of teeth 19 of the rotor 18 with teeth 21 of the rotor 20. The number of these areas depends on the number of threads of the helical rotor, which is determined by the length of the rotor and the pitch of the helical thread.

Figure 9:
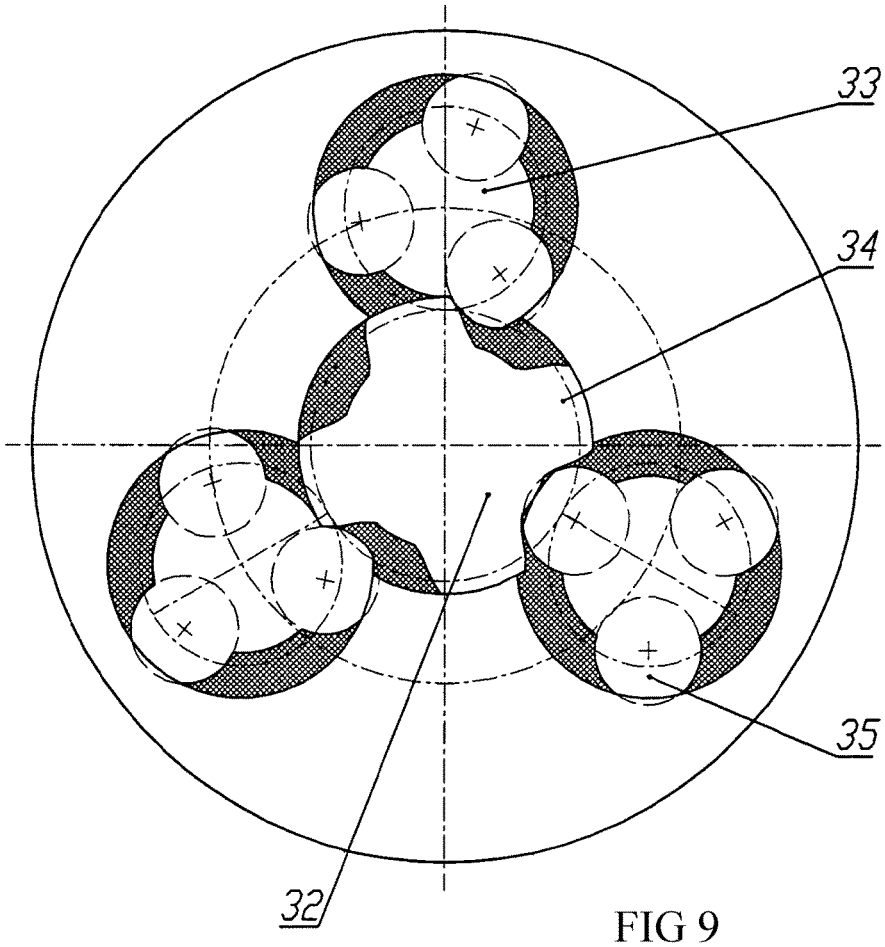
FIG. 9 shows the cross-section of an actuator comprising 4 rotors (three interacting pairs)

The actuator shown in section in FIG. 9 comprises one power 32 and three similar sealing rotors 33 producing three pairs of the EC engagement. In this layout, the power rotor 32 has four cycloidal helical teeth 34 and each of the sealing driven rotors 33 has three helical teeth 35 with the profile along the arc of the circumference.

Figure 10:
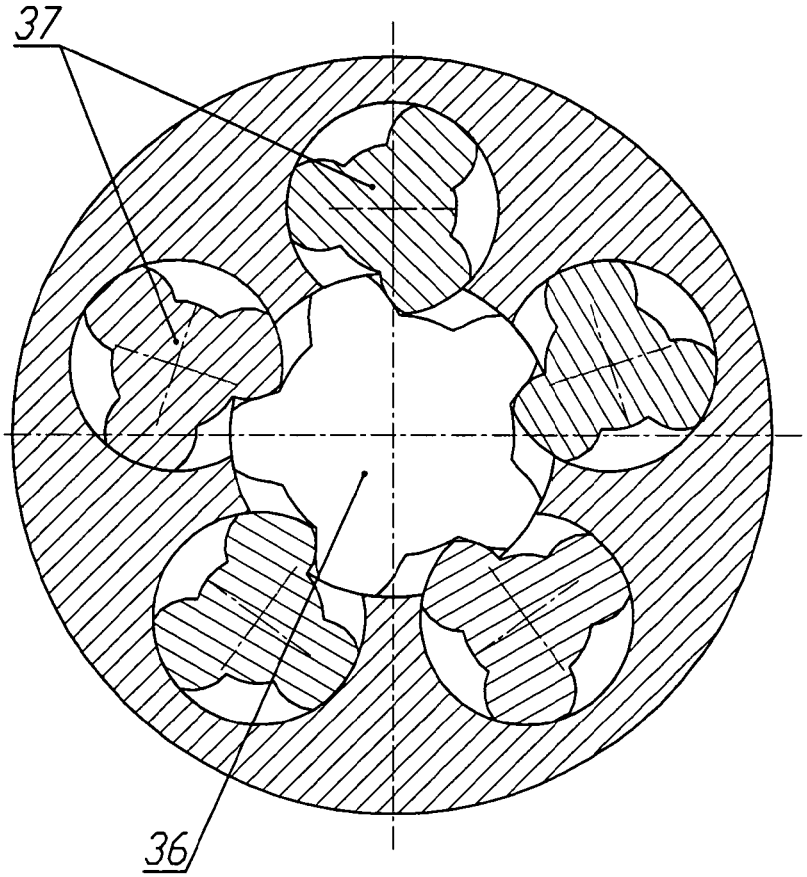
FIG. 10 presents the same section for 6 rotors (five interacting pairs).

The actuator in FIG. 10 has one power 36 and five sealing 37 rotors forming five pairs of the EC engagement. One should note here, that the choice of power and sealing rotors does not depend on the profile of their teeth. That is, the power rotor can have both cycloidal teeth and teeth with the profile along the arc of the eccentrically offset circumference.

Let us consider the operation of the actuator comprising two rotors, shown in FIGS. 1, 2, 3 when it is used as the pump. The power rotor in the pump is the driving one and it is connected with the shaft of the engine. Any type of rotor can be chosen as the power one for the considered actuator with equal diameters of rotors. In FIG. 1, the rotor 2 with cycloidal teeth is the power one. When the rotor 2 rotates, the liquid coming into the pump volume through the sleeve 38 fills the open helical canals formed by teeth 8 and 11 of rotors 1 and 2 and walls of chambers 6 and 7. These canals are designated by digits 14, 15 and 16 in FIG. 3. At some turn of screws the liquid moving with helical teeth is separated from the inlet chamber by the closing helical surface 17 of the contact with teeth of the next rotor. Further flow of the liquid is performed by the pressure of the contact surface 17 on it as of the pump. When screws 1 and 2 rotate, the contact surface 17 moves along the axis towards the pressure chamber and the liquid is forced out to it. The screw pump operates as the positive displacement pump where the contact surface 17 plays the role of continuously progressively moving pistons. The liquid passes through the pump progressively and smoothly. Due to the property of the EC engagement to operate only in the rolling mode at definite parameters, the clearance between rotors can be minimal without worsening the strength parameters of rotors. The minimum clearance will abruptly increase the leak resistance of the contact surface influencing a lot the productivity of the pump at other equal conditions.

When the same actuator operates as the component of engine, the liquid comes into the inlet of the chamber under pressure through the sleeve 38. Coming into open helical canals 14, 15 and 16 the liquid starts pressing on the boundary area of these canals and neighboring leak proof canals 14', 15' и 16' generated by contact surfaces 17. Tending to move away this boundary, the liquid causes the displacement of the contact surface 17 along the rotors, stimulating thus the rotation of rotors in the opposite direction with respect to each other. The torque is transmitted from the power rotor to the load.

The principle of operation of actuators illustrated in other figures is similar to the described above. As for the actuator in FIGS. 6, 7 and 8 the only difference is in the number of helical volumes at different tooth numbers for rotors in pair. Operation of actuators in FIGS. 9-10 differs by greater number of pairs of rotors and greater number of helical volumes. When increasing the radial dimensions of the machine, it allows for decreasing its axial dimensions, which becomes necessary for a certain number of applications.

What is claimed is:

1. An actuator of a rotary positive displacement machine, the actuator comprising:

a first rotor having helical teeth with working areas formed by convex segments of front portions of a cycloidal curve;

a second rotor (i) disposed parallel to the first rotor and (ii) having helical teeth with working areas formed by arcs of circumferences eccentrically offset from an axis of the second rotor and providing an eccentrically cycloidal engagement with the teeth of the first rotor; and a casing having chambers selectively housing the first and second rotors, each chamber having an opening for engaged portions of the first and second rotors.

2. The actuator of claim 1, wherein a number of the teeth of the first and second rotors is between 3 and 5.

3. The actuator of claim 1, wherein outer diameters of the teeth of the first and second rotors are the same.

4. The actuator of claim 1, wherein an outer diameter of the teeth of the first rotor is equal to or greater than an outer diameter of the teeth of the second rotor.

5. An actuator of a rotary positive displacement machine, the actuator comprising:

a driving rotor having helical teeth with working areas formed by convex segments of front portions of a cycloidal curve;

a plurality of driven rotors, each driven rotor (i) disposed parallel to the driving rotor and (ii) having helical teeth with working areas formed by arcs of circumferences eccentrically offset from an axis of a driven rotor and providing an eccentrically cycloidal engagement with the teeth of the driving rotor; and a casing having chambers selectively housing the driving and driven rotors, each chamber having an opening for engaged portions of the driving and driven rotors.

6. The actuator of claim 5, wherein a number of the teeth of the driving rotor or each of the driven rotors is between 3 and 5.

7. The actuator of claim 5, wherein an outer diameter of the teeth of the driving rotor is equal to or greater than outer diameters of the teeth of the driven rotors.

* * * * *